US005429158A

United States Patent [19]

Kurmis

[11] Patent Number: 5,429,158

[45] Date of Patent: Jul. 4, 1995

[54] TOOL FOR BINDING AN OBJECT, ESPECIALLY A CABLE HARNESS

[75] Inventor: Viktor Kurmis, Pinneberg, Germany

[73] Assignee: Bowthorpe plc, Crawley, England

[21] Appl. No.: 146,419

[22] Filed: Nov. 1, 1993

[30] Foreign Application Priority Data

Nov. 2, 1992 [DE] Germany ..... 9214903 U

[51] Int. Cl.[6] ..... B21F 9/02

[52] U.S. Cl. ..... 140/93.2; 140/123.6

[58] Field of Search ..... 140/93 A, 93.2, 123.5, 140/123.6

[56] References Cited

U.S. PATENT DOCUMENTS

| | | | |
|---|---|---|---|
| 3,946,769 | 3/1976 | Caveney et al. | 140/93.2 |
| 3,976,108 | 8/1976 | Caveney et al. | 140/93 A |
| 4,178,973 | 12/1979 | Collier et al. | 140/123.6 |
| 4,640,319 | 2/1987 | Walker | 140/93 A |
| 5,042,535 | 8/1991 | Schlottke | 140/93 A |
| 5,050,649 | 9/1991 | Kurmis | 140/93 A |

FOREIGN PATENT DOCUMENTS

| | | |
|---|---|---|
| 0390434A1 | 3/1990 | European Pat. Off. . |
| 0428116A1 | 11/1990 | European Pat. Off. . |
| 2401742 | 9/1978 | France . |
| 8913511 U | 11/1989 | Germany . |

*Primary Examiner*—Lowell A. Larson
*Attorney, Agent, or Firm*—Chilton, Alix & Van Kirk

[57] ABSTRACT

Tool for binding an object, especially a cable harness, by means of a strip which consists of a strip tongue and a lock which is firmly connected thereto and has a strip opening for retaining and fixing the free end of the strip tongue and at least one laterally projecting region in the bound state. In order to guide the strip tongue around the object which is to be bound, the tool comprises a loop guide which has at least one moving part for opening and closing. Provided for holding the lock during the binding process is a lock holder which is at least partially formed by a part which catches in front of the laterally projecting region of the lock. In order that this does not impede extraction of the lock from the lock holder, it is removable. In order to avoid a special bearing, drive device and controller, according to the invention, this part is connected to the moving part of the loop guide.

6 Claims, 2 Drawing Sheets

TOOL FOR BINDING AN OBJECT, ESPECIALLY A CABLE HARNESS

The invention relates to a tool for binding an object, especially a cable harness, by means of a strip which consists of a strip tongue and a lock which is firmly connected thereto and has a strip opening for receiving and fixing the free end of the strip tongue and at least one laterally projecting region. In order to guide the strip tongue around the object which is to be bound, the tool comprises a loop guide, of which at least one part is movable in order to open and close the loop guide. In order to hold the lock during the binding process, a lock holder is provided adjacent to the region which is enclosed by the loop guide and is free for receiving the object which is to be bound. This lock holder is at least partially formed by a part which can be removed to release the extraction of the lock from the lock holder after the binding process, but catches in front of the laterally projecting region of the lock during the binding process.

The lock must be held securely during the binding process, in order that the tip of the strip tongue which is to be inserted into the strip opening of the lock can meet this opening correctly. A laterally projecting region of the lock can be made use of for holding the lock, because parts of the lock holder can engage in front of this region. In this context, the lateral direction is to be seen as the extraction direction of the lock. A projecting region is distinguished by at least one surface which has a component which runs at right angles to the extraction direction and faces in the extraction direction.

However, a projecting region is not only useful with respect to the holding purpose but can also be obstructive during extraction of the lock as long as a holding part engages in front of it. Such a holding part must therefore be removable after the binding process for extraction of the lock. In this context, it is necessary to consider not only those regions of the lock which project laterally and are present thereon originally, but also those which occur for the first time as a result of the binding process, for example an end of the strip tongue which projects beyond the strip opening of the lock. The drive and control of moving holding parts is costly, especially in the context of confined spatial conditions in the holding region.

The invention therefore attempts to find a simple solution for moving and controlling a removable part of the lock holder, and finds the solution in a tool of the type described having at least one moving jaw part for guiding the strip tongue around the object to be bound and a lock holder for holding the lock during the binding process. The moving jaw part is movable between open and closed positions with the lock holder arranged on the circumference of the largest circle which can be accommodated within the loop guide. The lock holder is formed at least partially by stop members mounted on the moving jaw part for movement therewith. The stop members are effective upon movement of the moving jaw part toward its open position to eject the lock from the lock holder after the binding process. The stop members include a spur and laterally extending rest surfaces. The spur engages the lock between the free strip end projecting from the strip opening and the strip tongue end opposite the free end. The lateral rest surfaces are spaced from the loop guide by the spur and support the lock on opposite sides of the lock's strip opening. The moving jaw part has a pivoting axis located behind the lock holder with respect to the loop guide so that, during opening of the jaw, the end of the spur moves rapidly to eject the lock from the lock holder.

The connection of the removable holding part to the moving part of the loop guide makes it superfluous to provide special bearing, drive and control devices for the removable holding part. This results in a considerable simplification and a significant gain in space. In addition, an ejector effect is exerted on the lock and on the bound object when the removable part of the lock holder engages behind a part of the lock or of the bound object and, in consequence, drives the lock or the bound object during the opening movement of the loop guide. The invention is used irrespective of the way in which the moving part of the loop guide is guided. The simplest and most expedient form of the guide is the pivoting guide. If the pivoting axis is located behind the lock holder with respect to the extraction direction, the removable part of the holder receives a movement component directed laterally away from the lock. If the pivoting axis is located close to the lock holder on the side of the moving part of the loop guide, with respect to the extraction direction, the removable holding part receives a movement component in the extraction direction. Both movement directions are expediently combined with one another, so that the movement direction of the removable holding part during opening of the holder is moved obliquely to the side and in the extraction direction.

In a particularly expedient embodiment of the invention, the removable part of the lock holder comprises a spur which catches in the lock holder between the strip end which is attached to the lock and the free strip end projecting from the strip opening. This spur may form the start of the loop guide.

In the sense of space saving in the region of the lock holder, the invention feature can also be seen in that the removable part of the lock holder forms an opposing bearing for a blade which cuts off the projecting end of the strip tongue. A special device for this purpose is thus superfluous.

The invention is particularly useful when the lock is arranged on the circumference of the largest circle which can be accommodated in the free region within the loop guide. This arrangement is therefore worthy of aiming for, because the object which is to be bound (for example a cable harness) can then occupy the ideal circular outline in the clamping process, which is not possible, or is possible only in the case of accepting design complications, when the lock is arranged laterally outside this circle on an interstice which originates therefrom (U.S. application Ser. No. 3,891,012; EP-A 0,264,142, EP-A-0,428,116).

The invention is explained in more detail in the following text, making reference to the drawing which shows an advantageous exemplary embodiment, and in which.

Figure 1:
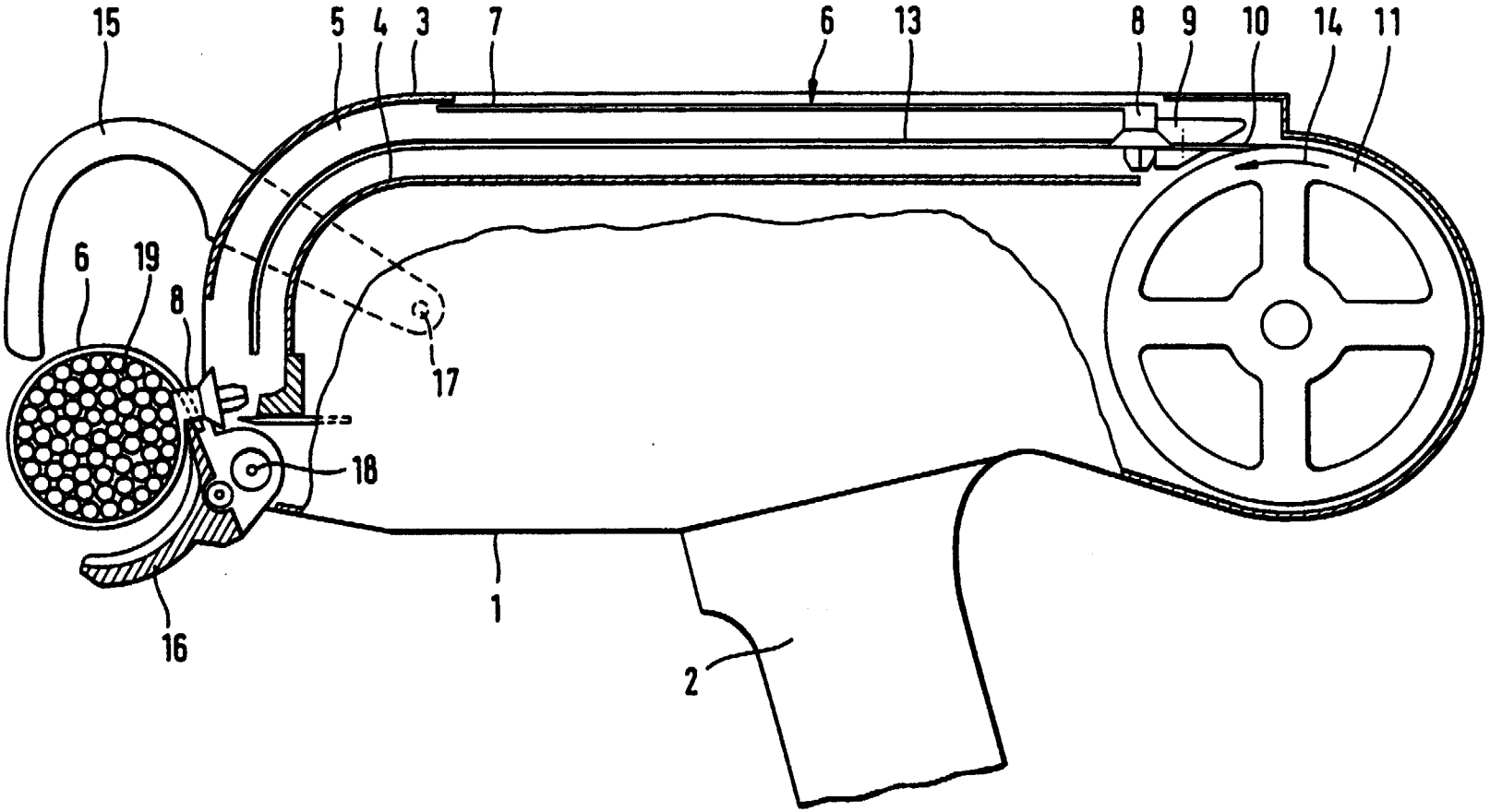
FIG. 1 shows a schematic longitudinal section through the tool.

According to FIG. 1, the tool has a tool body 1 and a handle 2 by which it can be held. Located between the walls 3 and 4 of the housing body i is a guide channel 5 for a strip 6 of viscoelastic synthetic material, such as polyamide. It passes in any desired manner into the position inside the channel 5 shown in FIG. 1, for example by automatic means, which are not shown, from a strip magazine, or by hand. The strip has a strip tongue 7 and a head 8, the tip of the strip tongue pointing towards the front end of the tool body, shown on the left in FIG. 1, while the head 8 is located at the rear. Located behind the lock 8 in the guide channel 5 is a slide head 9 whose end, which interacts with the lock 8, is matched to the shape of the lock 8, and which is attached to the front end of a flexible steel strip 10 which is wound on a roll 11. The head 9 and the steel strip 10 together form a slide for pushing the strip 6 out of the position shown in FIG. 1 into that position (FIG. 3) in which the strip is used for binding an object. If the roll 11 is rotated in the arrow direction 14, the steel strip 10 is pushed forwards with the slide head 9 along the guide channel 5.

At the front end, the tool has pliers which are formed by the parts 15 and 16. Said pliers form a guide for the strip 6 during its movement looping around the object which is to be bound. The part 15 of the pliers can pivot about the axis 17; the part 16 of the pliers can pivot about the axis 18. Drive and control means are provided which ensure that the parts of the pliers can pivot out of the open position shown in FIG. 1 into further functional positions, as is described in more detail below. These drive and control means are of a conventional type and are therefore not shown or explained.

In the opened position (FIG. 1), the pliers hold an object which is to be bound, which may be, for example, a harness of cables 19 (FIG. 2) which is intended to be firmly bound together by means of the strip 6, as is shown in the final phase in FIG. 1. In this phase, the strip tongue 7 surrounds the cable harness 19 under tension. The free end of the strip tongue 7 is guided through the lock 8 and is fixed therein. The projecting end of the strip tongue is cut off.

Figure 2:
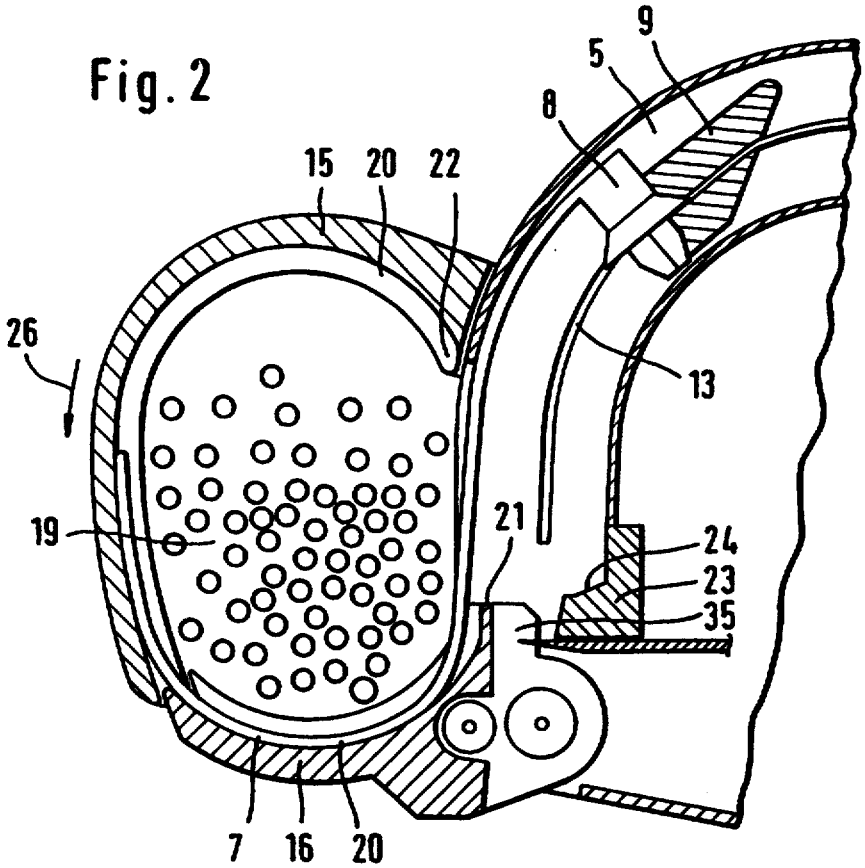
FIGS. 2 and 3 show longitudinal sections through the front tool region, on a larger scale, and different phases of operation.

In order that the strip tongue can be looped around the object 19 which is to be bound, the parts 15 and 16 of the pliers are moved into a closed looping-round position, according to FIG. 2. They contain a guide groove 20 whose width corresponds approximately to that of the strip tongue 7 and whose depth is considerably greater than the thickness of the strip tongue 7. The guide groove 20 is bounded at its start by a spur 21 which is firmly connected to the part 16 of the pliers. When the tip of the strip tongue 7 is inserted into the start of the guide groove 20, which is carried out using means which are not of interest here its further movement is determined by this groove around the object 19 which is to be bound and which ends at 22 on the inner end of the part 15 of the pliers.

When this final position is reached, the lock 8 has likewise reached its final position, which is determined by the lock holder. Said lock holder consists of a holding part 23 which is fixed to the housing and whose surface facing the lock 24 is at least partially matched to the shape of the lock. Furthermore, the already-mentioned spur 21 and the region 35 behind the spur 21, which is cut out in the plane of the drawing for the strip to pass through but on the sides thereof (above and below the drawing) can form stop surfaces for the lock, belong to the lock holder. In the position shown in FIGS. 2 and 3 of the part 16 of the pliers, the spur 21 and the part 35 together with the holding part 23 which is fixed to the housing form a stop which is matched to the shape of the lock 8 such that its position in the holder can be determined unambiguously, provided said lock 8 is pressed against this stop. This takes place by means of the slide head 9, which is constructed as a third holding part. As a result of a feed force, which is exerted continuously on the steel strip 11 and can be determined, for example, by means of a sliding clutch or spring in the drive of the roll 11, the slide head 9 presses the lock 8 against the holding parts 21, 23 and in consequence precisely determines the final position of the lock. At the same time, the spur 21 catches between the strip tongue 7, where the latter is integrally connected to the lock 8, and the aperture of the strip opening 25, which is indicated by dashed lines, for receiving the strip tongue in the lock. This means that, during the looping-round movement (FIG. 2), the tip of the strip must pass through on the front side, but behind the spur in the final state. The spur itself rests between these two strip regions as a stop on the lock body, and thus participates in the positioning of the latter. However, this is not absolutely necessary. It is necessary only that the holding parts 21, 23, 9 interact with the surface of the lock body in such a manner that its position is fixed unambiguously.

The lock is shaped such that the strip takes its origin approximately in the feed direction from the lock and such that the strip opening 25 is approximately parallel to this direction. Precise parallelism is not necessary. The strip opening could rather be rotated, when considering FIG. 3, for example, even a little in the anti-clockwise direction with respect to the direction shown.

When the lock 8 has reached its final position in the lock holder, the free end of the strip tongue is located approximately at the end 22 of the loop guide or between this end and the strip lock 8. The strip tip must now be inserted into the strip opening 25 of the lock. This is done by the part 15 of the pliers being pivoted further out of the loop position shown in FIG. 2., in the arrow direction 26. In consequence, the extent which is available in the loop guide for retaining the strip tongue 7 is shortened. Since the lock 8 is fixed during this, the strip tip must therefore move further. When the part 15 of the pliers has reached its final position shown in FIG. 3, the free end of the strip tongue 7 is passed through the strip opening 25, and has reached the gap between two clamping rollers 28, 29, which rotate in the arrow direction during this and grip and clamp the strip end.

Figure 3:
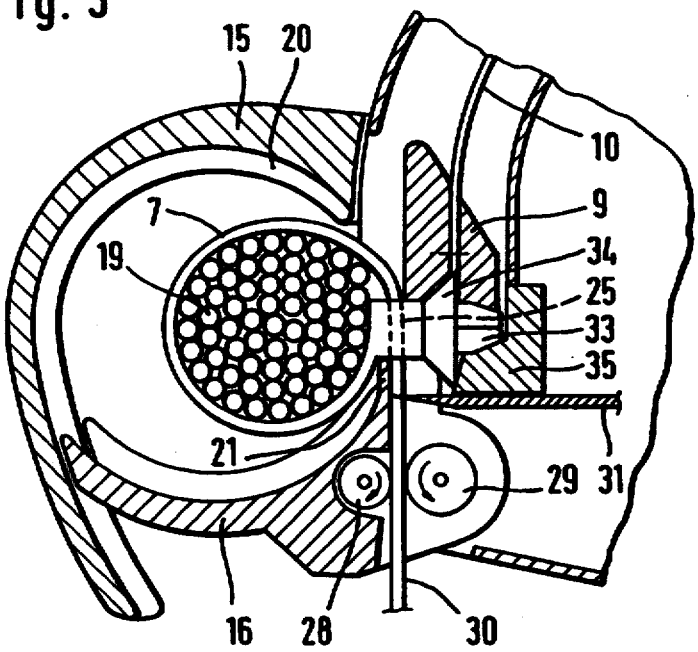

According to FIG. 3, the clamping process is continued until the desired tension in the strip tongue 7 is achieved and the object which is to be bound (cable 19) is firmly encircled.

A blade 31 is provided for cutting off the projecting strip end 30 which blade 31 is guided in its longitudinal direction and is connected to conventional drive and control means, which are not shown. In order to make the cut, it is moved to the left in FIG. 3, so that its blade cuts through the strip tongue. At the same time, it uses the spur 21 as an opposing bearing. It may be adequate for this, if the spur forms a smooth bearing surface for the strip in its opposing-bearing region, as shown. However, instead of this, an impression can be provided at this point into the surface of the spur, which depression forms an opposing blade or cutting edge which interacts with the blade.

During the positioning of the lock 8 in the lock holder by means of the part 23 which is fixed to the housing, the spur 21, the part 35 which is connected to the spur and the slide head 9, laterally projecting regions of the lock play a role, such as the plate 34 which, with the pin 33, belongs to attachment devices which, on the lock, are intended to be used for attachment to a holding plate, for example a switchboard. Allocated to the plate 34 are undercut surfaces on the slide head 9 and the part 35, which surfaces engage in front of the plate (with respect to the extraction direction).

The laterally projecting parts of the lock also include the free strip end 30 projecting on the other side of the lock, to the extent that this is not removed by the blade 31. The spur 21 engages in front of this projecting strip end.

All the holding parts which catch in front of the laterally projecting region of the lock 8 must be removed after the binding process in order that the lock can be extracted. In the case of the slide head 9, this is done by it being drawn back. With respect to the parts 21, 35, this is done by them being rigidly connected to the part 16 of the pliers and thus describing an arc during pivoting of said part 16 about the point 18, which arc point, pointing downwards and to the left in FIG. 1, that is to say both laterally and in the extraction direction. In consequence, a movement in the extraction direction, like an ejector, acts on the object. The opening also increases in size in consequence, through which the projecting parts of the lock can be extracted, so that the extraction is simplified.

What is claimed is:

1. Tool for binding an object, especially a cable harness, by means of a strip (6) which consists of a strip tongue (7) and a lock (8) which is firmly connected thereto and has a strip opening (25) for receiving and fixing the free end (30) of the strip tongue (7), the tool comprising a loop guide (15, 16) having at least one moving jaw part (16) for guiding the strip tongue (7) around the object (19) which is to be bound and a lock holder for holding the lock during the binding process, said moving jaw part being movable between open and closed positions, said lock holder being arranged on the circumference of the largest circle which can be accommodated within the loop guide, said lock holder being formed at least partially by stop means mounted on said moving jaw part for movement therewith, said stop means being effective upon movement of the moving jaw part toward its open position to eject the lock from the lock holder after the binding process, said stop means including a spur (21) which engages the lock between the free strip end (30) projecting from the strip opening and the strip tongue end opposite the free end.

2. Tool according to claim 1, characterised in that the moving jaw part has a pivoting axis (18) located behind the lock holder with respect to the loop guide.

3. Tool according to claim 1, characterised in the it includes a blade (31) for cutting off the projecting free end (30) of the strip tongue after the free end passes through the lock and the spur is effective to cooperate with the blade during the cutting operation.

4. Tool according to claim 1, characterised in that the spur forms the start of the loop guide.

5. Tool according to claim 1, characterised in that the lock holder is adapted to hold the lock in a position relative to the loop guide such that the strip opening is generally parallel to the strip tongue end immediately adjacent the lock.

6. Tool according to claim 1, characterised in that the stop means includes a lock rest surface spaced from the loop guide by the spur for supporting the lock.

* * * * *